United States Patent [19]

Clement

[11] 4,262,436

[45] Apr. 21, 1981

[54] DISPLAY DEVICE WITH PRICE-CHANGE CARTRIDGES

[75] Inventor: Joseph Clement, Bradenton, Fla.

[73] Assignee: The Mead Corporation, Dayton, Ohio

[21] Appl. No.: 95,970

[22] Filed: Nov. 20, 1979

[51] Int. Cl.[3] ..... G09F 11/18

[52] U.S. Cl. ..... 40/518; 40/16.4; 40/490

[58] Field of Search ..... 40/10 R, 10 D, 16, 16.2, 40/16.4, 518, 385, 611, 605, 618, 620, 622, 489, 490, 491, 117, 575, 576, 5, 610

[56] References Cited

U.S. PATENT DOCUMENTS

| | | | |
|---|---|---|---|
| 2,121,390 | 6/1938 | Roland | 40/489 |
| 3,159,937 | 12/1964 | Barnes | 40/5 X |
| 3,660,918 | 5/1972 | Bourseau | 40/575 |
| 3,685,186 | 8/1972 | Goodman | 40/576 X |
| 4,095,359 | 6/1978 | Trame | 40/518 X |
| 4,136,473 | 1/1979 | Coe | 40/518 |
| 4,171,584 | 10/1979 | Kaiser | 40/490 |
| 4,177,588 | 12/1979 | Gebhardt et al. | 40/518 X |
| 4,195,430 | 4/1980 | Suttles | 40/518 |

*Primary Examiner*—John F. Pitrelli
*Assistant Examiner*—G. Lee Skillington
*Attorney, Agent, or Firm*—Erwin Doerr

[57] ABSTRACT

A display device such as is used to display information relating to the description and price of goods for sale comprises a facia panel (10) to which is attached one or more cartridges (20) each carrying self-coiling information strips (29,30,31) readily adjustable so that the information regarding the goods may be quickly and easily changed, the attaching means (27,28) provided on the cartridge (20) and the attaching means (13,14,15,16) provided on the facia panel (10) co-operating to provide a push-pull connection.

7 Claims, 4 Drawing Figures

DISPLAY DEVICE WITH PRICE-CHANGE CARTRIDGES

This invention relates to a display device of the kind comprising a facia on which information relating to the description of goods for sale is presented together with price indicia such that the attention of a prospective customer is attracted. Such devices are known in which the price and/or other information regarding products may be quickly and easily changed by presenting the information with the use of self-coiling or pre-coiling plastic film strips.

One such device provides a facia having a plurality of window openings therein and to which is attached a plurality of holders supporting self-coiling information strips so that information such as price indicia is presented for display in the window openings. This known construction has the disadvantage that the holders are not immediately detachable from the facia, so making the replacement of the information strips a tedious and time-consuming operation. A further drawback of the known device is that the basic format of the display cannot be altered. The display device of the present invention overcomes both the above disadvantages by providing immediately removable information strip cartridges and by providing an assembly in which the format of the facia can be readily altered.

One aspect of the present invention provides a display device comprising at least one information strip, each strip having thereon a series of characters and being mounted on a carrier for slideable adjustment with respect thereto whereby the characters can be sequentially displayed on the carrier, the carrier being connected to a facia so that each character displayed on the carrier can be observed through the facia wherein the improvement comprises complementary attaching means provided on the carrier and on facia said means co-operating to provide a push-pull connection between the carrier and the facia.

A display device comprising at least one information strip, each strip having thereon a series of characters and being mounted on a carrier for slideable adjustment with respect thereto whereby the characters can be sequentially displayed on the carrier, and a facia formed by a continuous translucent panel having a front face and a back face, the back face including at least one pair of projections, and wherein said carrier comprises at least one pair of legs for co-operating attachment with said projections so that the carrier can be connected on the back face of the facia thereby permitting characters displayed on the carrier to be viewed through the front face of the facia.

Figure 1:
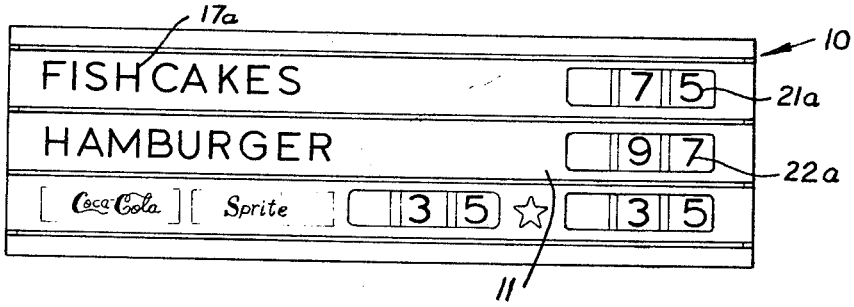
Figure 2:
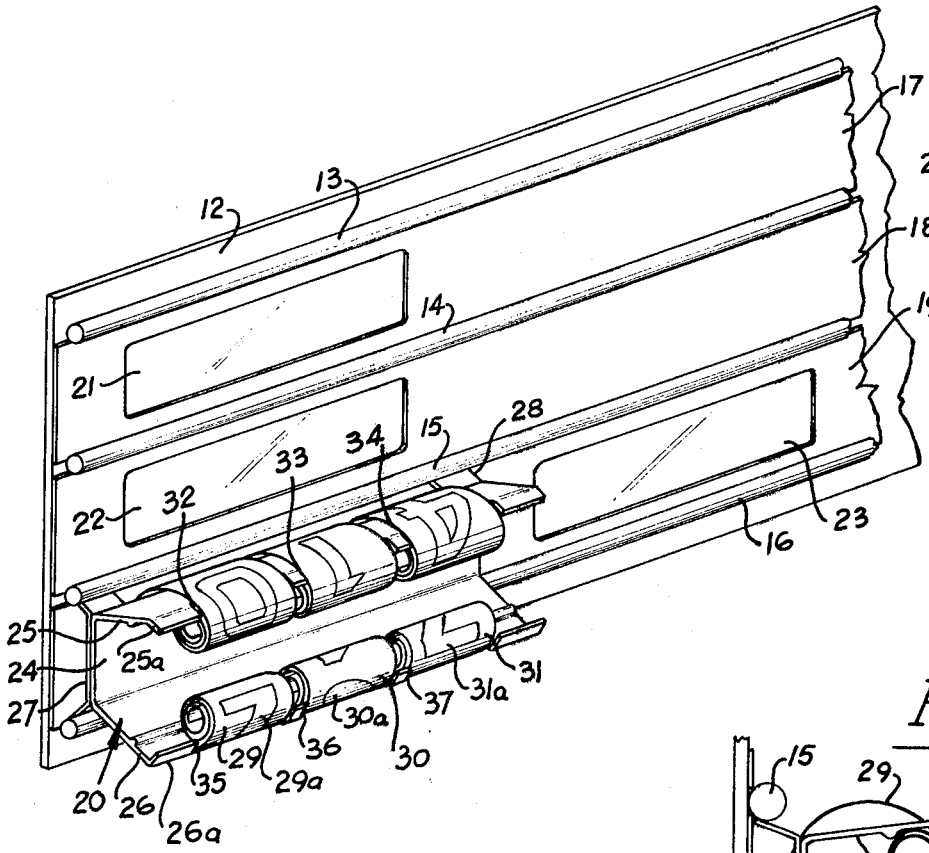
Figure 4:
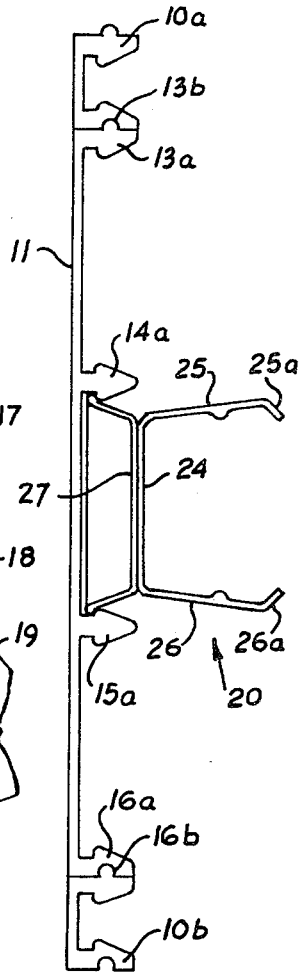
Figure 3:
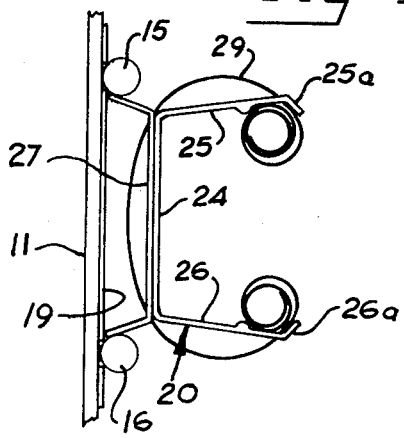

The invention is described in more detail in the following description taken in conjunction with the accompanying drawings set forth by way of illustration only, in which:

FIG. 1 is a front view of the facia of a display device according to the invention, FIG. 2 is a perspective view taken from behind the facia and showing a cartridge connected thereto, FIG. 3 is a cross section through the cartridge and a portion of the facia, and FIG. 4 is an end view of a facia with trim-strips and a cartridge connected but having attaching means different to those illustrated in FIGS. 1 to 3.

Referring first to FIG. 1 there is shown an elongate facia 10 comprising a panel formed from a translucent material such as clear acrylic or other plastics for the display of information, particularly information relating to goods for sale. The panel has an uninterrupted front surface 11, that is to say there are no apertures formed in the panel. Hence information to be presented on the facia 10 is attached adjacent its rear surface 12 and is viewed through the translucent material. It is not essential that the panel is formed from a translucent material. It is not essential that the panel is formed from a translucent material and it is envisaged that any suitable opaque material such as wood, plastics or metal also could be used, although in this event window openings in the panel would be required to allow the displayed information to be viewed. However, such a construction loses one of the inherent advantages of the invention which is the versatility in the format of the facia as will become apparent.

The rear surface 12 of the panel as shown in FIG. 2 is formed with a series of spaced apart elongate rails 13, 14, 15 and 16 which in this embodiment comprise projecting beading of circular cross section formed integrally with the panel 10. The rails may, of course, comprise separate components which are fixed on to surface 12 by suitable means such as gluing. The rails serve two purposes; first to retain card inserts 17, 18, 19 in position and secondly to provide means by which cartridges similar to cartridge 20 are secured to the panel.

The inserts are formed from paperboard or other suitable printable material such as plastics and are mounted on the facia 10 by being slid between a pair of adjacent rails. Insert 17 is sized to be slidingly received between adjacent rails 13, 14 and similarly inserts 18 and 19 are slidingly received between rails 14, 15 and 15, 16 respectively. The face of each insert adjacent the rear surface 12 of the facia 10 is provided with information e.g. a description of goods to be sold, such as that shown by numeral 17*a* which can be viewed from the front of the facia 10 as illustrated in FIG. 1. Each insert also is provided with one or more window openings e.g. insert 17 includes window opening 21, and inserts 18 and 19 are formed with window openings 22, 23 respectively. It will be apparent that the purpose of such window openings is to enable information such as price indicia e.g. 21*a*, 22*a* carried by cartridges similar to cartridge 20 mounted adjacent the near surface of the panel to be viewed through the translucent material from the front of the facia 10.

It also will be apparent that the number and disposition of the window openings in each insert can be varied as desired thus making for a readily changeable display arrangement. Moreover, it is envisaged that the device could be employed without the use of inserts. In this event the display could be constituted solely by the information presented by the cartridges 20 or alternatively the panel itself could be printed or otherwise marked with information to be displayed.

The cartridge illustrated in FIGS. 2 to 4 of the drawings comprises an elongate plastics carrier of generally 'U'-shaped cross section. The base of the 'U' provides a support surface 24 from which extend a pair of divergent side walls 25, 26 terminating in angled lips 25*a*, 26*a*. A pair of resilient legs 27, 28 adjacent opposite ends of the cartridge extend outwardly in the opposite direction to that of the side walls 25, 26. The legs of each pair are divergent to give them a degree of resilience as is explained more fully below. At least the legs 27, 28 of the cartridge preferably are made from plastics material to give the required resilience for a snap-on connection as will be described. However, as will also be described, the cartridge may be made from a less resilient material e.g. metal and then can be a slide fit on the facia 10.

The cartridge supports three self-coiling information strips 29, 30 ,31 in side by side relationship each of which are made from a material having a tendency to form coils at its opposite ends when unrestrained. Such a material is known in the art, e.g. the heat treated polyethylene terephtalate disclosed in U.S. Pat. No. 3,426,115 (Taber), which is a material having the tendency to form coils at opposite ends when unrestrained. One such material is sold under the registered trademark 'Spring-Roll.' However, it is envisaged that the strips could comprise endless belts or alternatively, tapes rolled on to a pair of spools.

The strips 29, 30, 31 are each provided with a series of indicia or other information generally referred to by the term characters, as at 29*a*, 30*a*, 31*a* respectively and are mounted on the cartridge so as to be slidably adjustable. The opposite coiled ends of each self-coiling strip 29, 30, 31 are accommodated in the 'U'-shaped cavity defined by the rear of the support surface 24 and the two side walls 25, 26 so that an uncoiled portion of the strip passes across the support surface 24 of the carrier. The self-coiling strips can be adjusted so that the characters are sequentially displayed in the non-coiled section adjacent support surface 24 merely by applying finger pressure and moving the strip in a manner tending to transfer a length of the strip from one coiled end to the other.

The angled lips 25*a*, 26*a* are each formed with a series of recesses defined by cut-out portions of the side walls, as at 32, 33, 34 in lip 25*a*, and 35, 36, 37 in lip 26*a*. Portions of strips 29, 30, 31 adjacent their coiled ends are located in these recesses to prevent lengthways movement of the strips with respect to the cartridge. It is envisaged that the cartridge may have more or less strips than those illustrated as is also the case with respect to the resilient legs 27, 28.

The cartridge 20 is mounted adjacent the rear surface 13 of the facia 10 such that the legs 27, 28 resiliently are pressed against a pair of adjacent rails as at 15, 16. This attachment may be achieved first squeezing together the limbs of legs 27, 28 and then pushing the cartridge 20 on to the back surface 12 thereafter releasing the legs so that they spring resiliently into abutment with the rails thereby providing a 'snap-on' connection or alternatively by sliding the cartridge 20 from one end of the facia so that the leg pairs 27, 28 resiliently are located between rails 15, 16. In either case a push-pull attachment exists whereby the cartridge is immediately attachable and detachable, respectively, from the facia 10 so providing for ease of adjustment of the self-coiling strips and variability in the positioning of the cartridge. This latter feature together with the versatility of the inserts provides a display device whose format is readily variable.

It will be appreciated that when inserts such as those designated 17, 18, 19 are interposed between the facia back surface 12 and the cartridges, the cartridges are positioned so that the characters between the coiled ends of the trips are in register with a window of the appropriate corresponding insert so that the character is viewed from the front of the facia 10.

It also will be appreciated that whilst the cartridges 20 are attached to the facia 10 the self-coiling strips are readily accessible for adjustment merely by reaching over the facia and manipulating the strips.

It is further envisaged that the means provided on the rear surface 12 of the facia for the attachment of cartridges need not be continuous rails, as illustrated. For example, a series of spaced pairs of projections may be provided for co-operation with the cartridges.

FIG. 4 shows a modified arrangement which is the preferred embodiment and in which the attachment means on the rear surface 12 of the facia comprise rails 13*a*, 14*a*, 15*a* and 16*a*, but the rails of this embodiment are 'arrow'-shaped in cross section to enhance the attachment of the cartridges. However, the cartridge 20 is attached to this facia in the same way as described in the previous embodiment i.e. either by squeezing together the limbs of legs 27 and 28 (not shown) and then snapping on the cartridge between a pair of adjacent rails or sliding the leg pairs between a pair of adjacent rails.

Rails 13*a* and 16*a* are half arrow-shaped and present a projection 13*b* and a recess 16*b* respectively for the attachment of trim-panels 10*a*, 10*b*. The trim-panels have co-operating projections and recesses to provide a snap-fit on to panel 10.

I claim:

1. A display device comprising a facia (10) of translucent material, a cartridge (20) attached to the rear surface of said facia and including a carrier, at least one self-coiling information strip (29) bearing a series of characters and being mounted on said carrier for slidable adjustment whereby the characters can be sequentially displayed and are observable through the translucent material, and complementary attaching means provided on the rear surface of said facia and on said cartridge for attaching said cartridge to said facia, characterized in that said cartridge comprises a carrier of generally U-shaped cross section including a support surface (24) on which an uncoiled portion of said self-coiling strip displays a character, side walls (25, 26) extending rearwardly from said support surface, said side walls together with said support surface defining a storage cavity in which the coiled ends of said information strip are accommodated, and resilient legs (27, 28) extending from said support surface in a direction opposite to that of said side walls and arranged to engage said attaching means provided on the rear surface of said facia.

2. A display device according to claim 1 wherein the facia is a continuous translucent panel whereby a character displayed on the carrier is observable through the translucent material.

3. A display device according to claim 1 wherein each side wall includes a recess provided by a cut-away part of that wall, a portion of each information strip adjacent its coiled ends being received in the recess to restrain movement of the strip along the cartridge.

4. A display device according to claim 3 wherein a plurality of recesses are formed in the side walls whereby a series of strips can be carried by the cartridge in side by side relationship.

5. A display device according to claim 1 wherein the complementary attaching means includes at least one pair of projections provided on the rear surface of said facia and being spaced apart so as to provide a snap-on connection between the legs and the projections.

6. A display device according to claim 5 wherein an insert is slideably received between said pair of projections and interposed between said panel and said cartridge, each insert having a surface for displaying information observable through the translucent material and at least one recess defining a window area sized such that when the cartridge and insert are appropriately located on the panel a character displayed on the carrier is presented in the window and observable through the translucent material.

7. A display device according to claim 5 in which said projections comprise parallel rails extending across the back face of the facia and in which said legs are resiliently deformable, the legs of each pair being squeezed together, inserted between the rails and released so that the legs resiliently spring apart into abutment with the rails to provide a snap-on attachment between the carrier and the facia.

* * * * *